US011584554B2

(12) United States Patent
Toro

(10) Patent No.: US 11,584,554 B2
(45) Date of Patent: Feb. 21, 2023

(54) METHOD AND SYSTEM FOR REALISING PACKAGES

(71) Applicant: SYSTEM CERAMICS S.R.L., Fiorano Modenese (IT)

(72) Inventor: Andrea Toro, Fiorano Modenese (IT)

(73) Assignee: SYSTEM CERAMICS S.P.A., Fiorano Modenese (IT)

( * ) Notice: Subject to any disclaimer, the term of this patent is extended or adjusted under 35 U.S.C. 154(b) by 164 days.

(21) Appl. No.: 16/964,073

(22) PCT Filed: Mar. 1, 2019

(86) PCT No.: PCT/IB2019/051648

§ 371 (c)(1),
(2) Date: Jul. 22, 2020

(87) PCT Pub. No.: WO2019/171226

PCT Pub. Date: Sep. 12, 2019

(65) Prior Publication Data

US 2021/0047063 A1 Feb. 18, 2021

(30) Foreign Application Priority Data

Mar. 7, 2018 (IT) ..... 102018000003334

(51) Int. Cl.
*B65B 43/60* (2006.01)
*B65B 23/20* (2006.01)
(Continued)

(52) U.S. Cl.
CPC ..... *B65B 23/20* (2013.01); *B65B 27/02* (2013.01); *B65B 35/50* (2013.01); *B65B 43/60* (2013.01); *B65B 65/003* (2013.01)

(58) Field of Classification Search
CPC ..... B65B 43/42; B65B 43/50; B65B 43/60; B65B 43/62; B65B 23/20; B65B 35/50
See application file for complete search history.

(56) References Cited

U.S. PATENT DOCUMENTS

2002/0170278 A1* 11/2002 Hofmann ..... B65G 57/11 53/540
2016/0039589 A1* 2/2016 Theriault ..... B65B 27/08 206/451
2019/0039762 A1 2/2019 Toro

FOREIGN PATENT DOCUMENTS

CN 201647154 11/2010
CN 102774523 A 11/2012
(Continued)

*Primary Examiner* — Chelsea E Stinson
(74) *Attorney, Agent, or Firm* — Pearne & Gordon LLP; J. Gregory Chrisman

(57) ABSTRACT

A method for realising a package that comprises the following steps: arranging a first longitudinal edge (2) of the package in a substantially horizontal position; stacking a predefined number of ceramic tiles (T) to form a pile (P) on the 5 first longitudinal edge (2); arranging a second longitudinal edge (3) of the package on the pile (P); associating a bottom (4) of the package with a first longitudinal side of the first and of the second longitudinal edge (2,3); associating a first transversal edge (5) of the package with a first 10 transversal side of the first and of the second longitudinal edge (2,3); associating a second transversal edge (6) of the package with a second transversal side of the first and of the second longitudinal edge (2,3); rotating the package resting on the bottom (4).

5 Claims, 4 Drawing Sheets

(51) Int. Cl.

| | |
|---|---|
| ***B65B 27/02*** | (2006.01) |
| ***B65B 35/50*** | (2006.01) |
| ***B65B 65/00*** | (2006.01) |

(56) References Cited

FOREIGN PATENT DOCUMENTS

| | | | | |
|---|---|---|---|---|
| DE | 2306574 | | 8/1974 | |
| DE | 202007007572 | | 10/2007 | |
| DE | 202012007772 | | 10/2012 | |
| JP | 2004067248 | | 3/2004 | |
| RU | 2536445 | C2 | 12/2014 | |
| WO | 2010061312 | A2 | 6/2010 | |
| WO | 2017149422 | A1 | 9/2017 | |
| WO | WO-2017149422 | A1 * | 9/2017 | ..... B65B 11/48 |

* cited by examiner

METHOD AND SYSTEM FOR REALISING PACKAGES

The present invention relates to a method and system for realising packages.

The invention is particularly useful in the logistics of systems for manufacturing ceramic tiles, and in particular to facilitate the transport of groups of tiles, both of small and large formats, stacked on top of each other.

Currently, for the movement and transport of tiles, packages are used that comprise a cardboard frame that surrounds the edges of the tiles adjacent to each other or stacked. A predefined number of packs is stabilised by means of straps resting on a pallet, which is then used as a support base and as a lifting and transport element for the packages.

The use of straps, which is necessary for stabilising the packs, represents a substantial financial waste, both in terms of material costs and in terms of the time necessary for installing the straps. Furthermore, the system described above does not allow individual packages to be picked while keeping the others stable. In other words, once the integrity of the strap system is compromised, the packages are no longer retained in a stable configuration by any means. A further limit of the packages described above is that no more than two/three units can be stacked on top of each other.

Furthermore, in the case of large tiles, or in the case of tiles in the form of strips, stabilisation by means of straps is not sufficient to allow safe transport of the packages and therefore wooden cases need to be used, which are relatively expensive and bulky. Such wooden cases must also be kept available for the system occupying substantial amounts of space at the edge of the system. In the event in which a system produces a certain number of different formats, it is further necessary to have available cases of the corresponding format, thus increasing the costs and spaces necessary for the provision and maintenance of the cases.

The aim of the present invention is to offer a method and a system for realising packages which allows the drawbacks of the currently available packages and methods to be obviated.

An advantage offered by the present invention is that it allows the realisation of stable and safe packages without needing to use straps.

Another advantage offered by the present invention is that it allows packages to be realised that can be stacked on top of each other in a number of units that is much higher than for current packages.

A further advantage offered by the present invention is that it allows packages to be realised that are comparable with the cases currently used, but starting from flat elements that can be stored loose, and therefore require substantially smaller storage spaces than those required by the current cases.

A further advantage of the present invention is that the packages obtained notably facilitate the picking of the individual tiles or packs of tiles, while keeping the remaining ones stable.

Further characteristics and advantages of the present invention will become more apparent in the following detailed description of an embodiment of the present invention, illustrated by way of non-limiting example in the attached figures, wherein.

Figure 2:
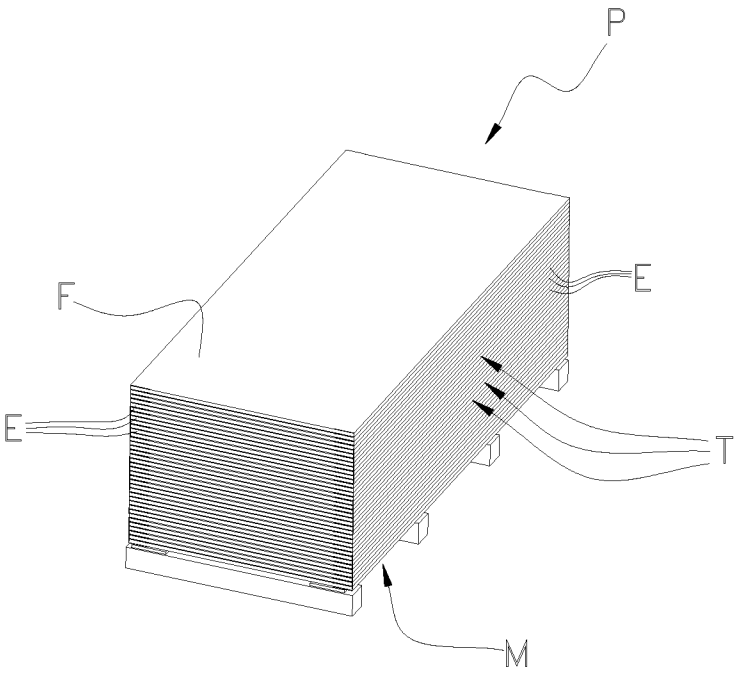
FIG. 2 shows a pile of tiles that can be contained in the package according to the present invention.
Figure 1:
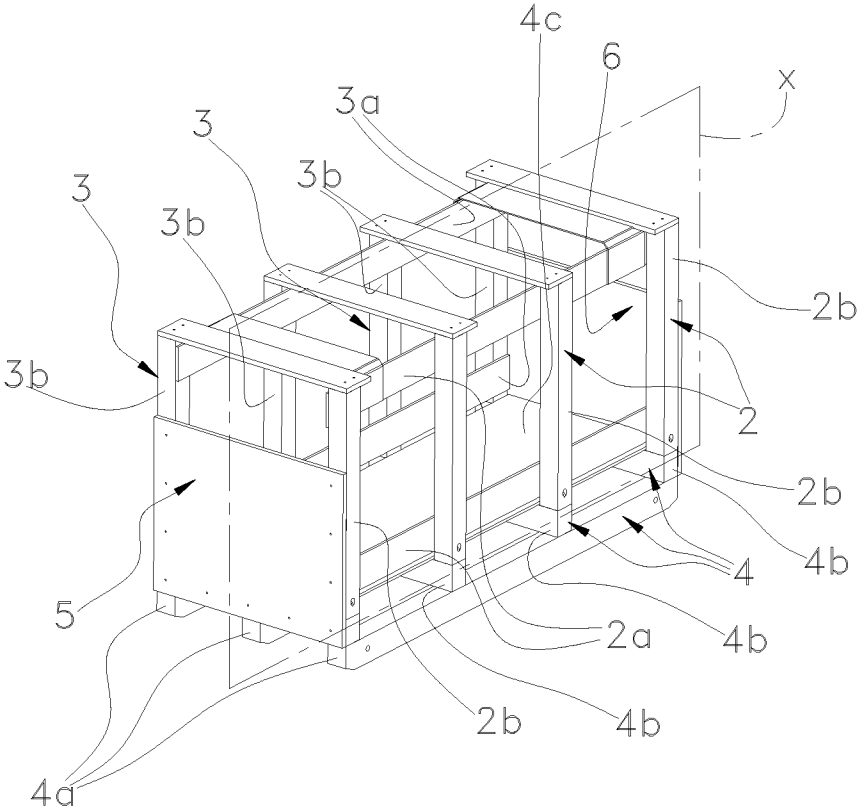
FIG. 1 shows a package realised according to the present invention.

The invention substantially relates to a package in the form of a parallelepiped provided with a bottom (4), two longitudinal edges (2,3), substantially perpendicular to the bottom (4) and parallel to a longitudinal plane (X), and two transversal edges (5,6), substantially perpendicular to the bottom (4) and to the longitudinal edges (2,3) and parallel to a transversal plane (Y). The edges (2,3,5,6) are connected to the four sides of the bottom (4) (FIG. 1). The bottom (4) and the edges (2,3,5,6) are mutually connected in order to delimit a containment volume, adapted to contain a pile (P) of slab-shaped objects, e.g. tiles (T) superposed with each other. The slab-shaped objects could be either ceramic tiles (T), or objects of another type realised with different materials. Furthermore, the slab-shaped objects or tiles (T) could be loose, i.e. unconstrained from one another and stacked directly onto each other, or could be grouped into packs already packaged in a known way. In that case the pile (P) is formed by tiles grouped into distinct packs.

The tiles (T) have two main surfaces being parallel to each other, i.e. a laying surface (M), intended to be laid onto a surface to be covered, and a visible surface (F), intended to remain exposed after the laying of the tile. The tiles (T) further have four lateral faces (E), with a reduced height, substantially perpendicular to the main surfaces.

In one pile (P), the tiles (T) are superposed on the main surfaces. The pile (P) therefore has two main surfaces, defined respectively by a main surface of the first and of the last tile of the pile (P), and four lateral faces, substantially defined by the lateral faces (E) of the tiles (T). The lateral faces of the pile (P), except in the case of imperfect alignment between the tiles (T), are flat overall.

Figure 3:
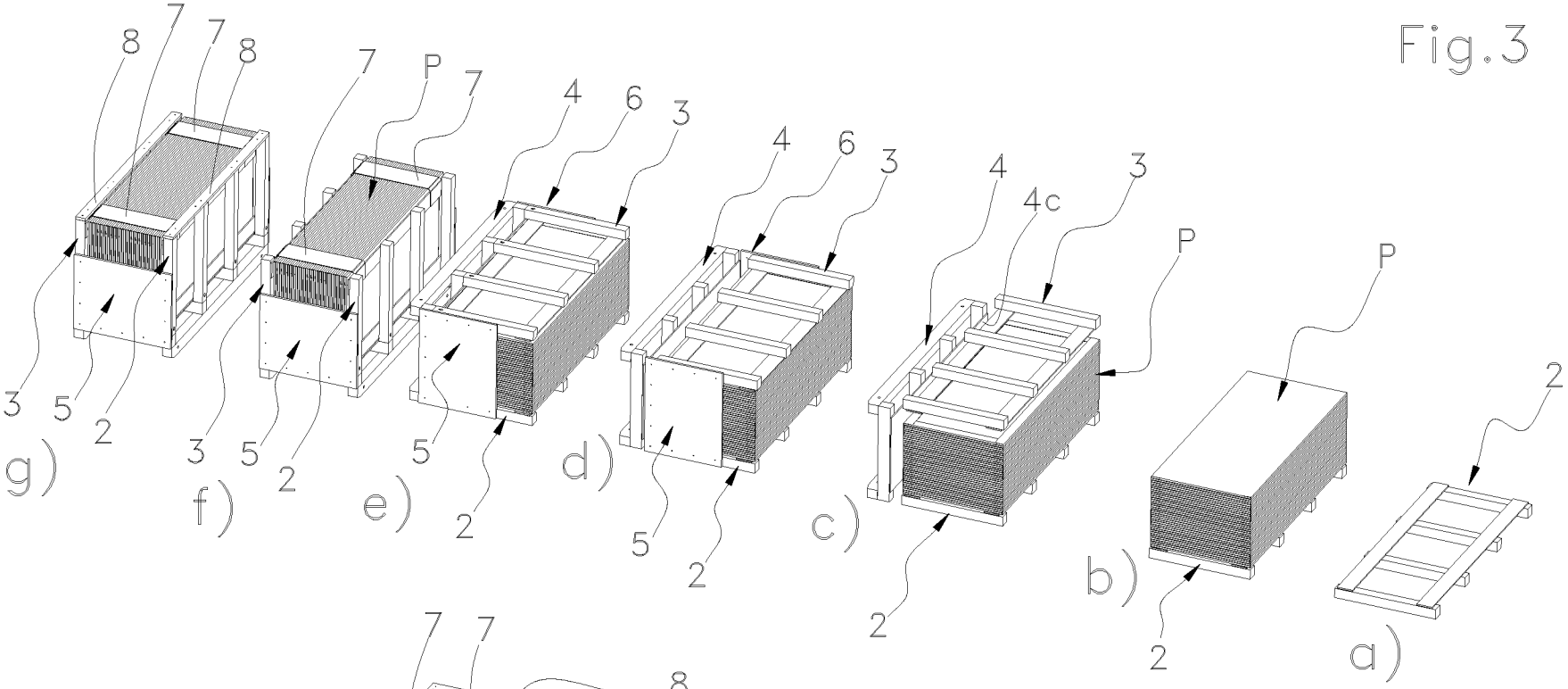
FIG. 3 shows various steps a, b, c, d, e, f, g through which the package of FIG. 1 can be realised.
Figure 4:
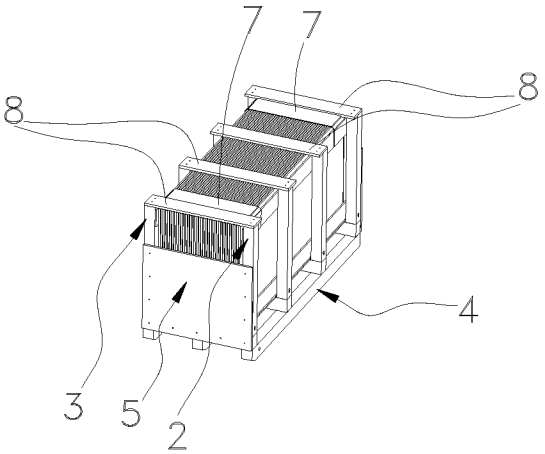
FIG. 4 shows a variant of the package of FIG. 3*g;*

The package described above can be realised advantageously with the method according to the present invention, the steps of which are illustrated schematically in FIG. 3, from a) to g).

The method envisages arranging a first longitudinal edge (2) of the package in a substantially horizontal position. The first longitudinal edge (2) is preferably realised by two or more longitudinal elements (2*a*), parallel to each other, which are connected by two or more transversal elements (2*b*), perpendicular to the longitudinal elements (2*a*). Advantageously, the transversal elements (2*b*) project from the longitudinal elements (2*a*) and are distanced from each other so as to allow the insertion of a lifting element, such as for example the forks of a fork-lift truck, below the longitudinal elements (2*a*). For example, the longitudinal (2*a*) and transversal (6*b*) elements can be made of wood. The number and arrangement of the longitudinal elements (2*a*) and the transversal elements (2*b*) can vary according to the dimensions and shape of the tiles (T). The first longitudinal edge (2) could also be realised in the form of a slab, possibly provided with external reinforcement transversal elements, distanced from each other to allow the insertion of a lifting element, as described above.

The first longitudinal edge (2) can be arranged in a substantially horizontal position on a support structure not illustrated.

Subsequently, the method envisages stacking a predefined number of ceramic tiles (T) to form a pile (P) on the first longitudinal edge (2). The tiles (T) are stacked onto each other on their own main surfaces. The stacking of the tiles (T) can be performed with the aid of a palletising device, not illustrated as it is known to a person skilled in the art, which is normally used in all tile packaging systems. In that case, the longitudinal edge (2) is arranged in a substantially horizontal position resting on the base plane of the palletiser.

Once the pile (P) of tiles has been formed on the first longitudinal edge (2), the method envisages arranging a second longitudinal edge (3) of the package on the pile (P).

The second longitudinal edge (3) can be structured differently from the first longitudinal edge (2), or it can be the same as the first longitudinal edge (2). In the second case, the method can be performed using a single type of longitudinal edge, to the advantage of the storage and management simplicity of the necessary stocks. In the second case, also the second longitudinal edge (3) is preferably realised by two or more longitudinal elements (3*a*), parallel to each other, which are connected by two or more transversal elements (3*b*), perpendicular to the longitudinal elements (3*a*). Advantageously, the transversal elements (3*b*) project from the longitudinal elements (3*a*) and are distanced from each other so as to allow the insertion of a lifting element, such as for example the forks of a fork-lift truck, between the longitudinal elements (3*a*). For example, the longitudinal (3*a*) and transversal (3*b*) elements can be made of wood. The number and arrangement of the longitudinal elements (3*a*) and the transversal elements (3*b*) can vary according to the dimensions and shape of the tiles (T). The second longitudinal edge (3) could also be realised in the form of a slab, possibly provided with external reinforcement transversal elements, distanced from each other to allow the insertion of a lifting element, as described above.

Subsequently, the method envisages associating a bottom (4) of the package at a first longitudinal side of the first and of the second longitudinal edge (2,3), at a bottom flank of the pile (P).

The bottom (4) is preferably realised by two or more longitudinal elements (4*a*), parallel to each other, which are connected by two or more transversal elements (4*b*), perpendicular to the longitudinal elements (4*a*). In the embodiment shown, the transversal elements (4*b*) are arranged so as to come into contact with the pile (P). Advantageously, the transversal elements (4*b*) project from the longitudinal elements (4*a*) and are distanced from each other so as to allow the insertion of a lifting element, such as for example the forks of a fork-lift truck. Also the longitudinal elements (4*a*) are distanced from each other so as to allow the insertion of a lifting element, such as for example the forks of a fork-lift truck. In the embodiment shown, the transversal elements (4*b*) are interposed between the longitudinal walls (2,3) and the longitudinal elements (4*a*). In this way, the lifting element can be inserted along a transversal direction between the longitudinal elements (4*a*) and the side of the longitudinal walls (2,3), in the spaces between the transversal elements (4*b*), or in the space comprised between the longitudinal elements (4*a*), along a longitudinal direction, below the transversal elements (4*b*).

The bottom (4) can further comprise a slab or panel (4*c*). In the embodiment shown, the panel (4*c*) is associated with the transversal elements (4*b*), so as to be placed in contact with the pile (P). The panel (4*c*) allows the flank of the pile (P) to be further protected. Preferably, the panel (4*c*) has dimensions substantially corresponding to those of the flank of the pile (P) with which it is placed in contact. In practice, the panel (4*c*) has one side about the same length as the height of the pile (P) and the other side the same length as the flank of the tiles and of the pile (P).

The longitudinal (4*a*) and transversal (4*b*) elements and the possible panel (4*c*) can be made of wood. The number and arrangement of the longitudinal elements (4*a*) and the transversal elements (4*b*) can vary according to the dimensions and shape of the tiles (T). The bottom (4) may also be realised in the form of a slab, possibly provided with external reinforcement transversal elements, distanced from each other to allow the insertion of a lifting element, as described above.

The method therefore envisages associating a first transversal edge (5) of the package with a first transversal side of the first and of the second longitudinal edge (2,3), at a first transversal flank of the pile (P).

In the embodiment shown, the first transversal edge (5) is in the form of a slab or panel, for example made of wood. In other possible embodiments, the first transversal edge may be made in the form of a strip or in the form of a set of longitudinal and transversal elements, like the longitudinal edges (2,3) illustrated.

The longitudinal edges (2,3) may be connected directly to the bottom (4) or, as in the embodiment shown, they may be connected to the bottom (4) through the first transversal edge (5), which is connected to both the longitudinal edges (2,3) and the bottom (4). In particular, in the embodiment shown the transversal edge (5) is connected, at two opposite sides, to two transversal elements (2*b*,3*b*) that respectively define a first side of the first and of the second longitudinal edge (2,3). The transversal edge (5) is also connected, at a third perpendicular side to the previous ones, to a transversal element (4*b*) that defines a first side of the bottom (4).

A combination of the two solutions is also possible, wherein the longitudinal edges (2,3) are connected both directly to the bottom (4), and to the first transversal wall (5) which is, in turn, connected to the bottom wall (4).

It is subsequently possible to associate a second transversal edge (6) of the package with a second transversal side of the first and of the second longitudinal edge (2,3), at a second transversal flank of the pile (P).

For the second transversal edge (6) the considerations made for the first transversal edge (5) are substantially valid. In substance, also the second transversal edge (6) may be in the form of a slab or panel, for example made of wood. In other possible embodiments, the second transversal edge may be made in the form of a strip or in the form of a set of longitudinal and transversal elements, like the longitudinal edges (2,3) illustrated.

In particular, in the embodiment shown the second transversal edge (6) is connected, at two opposite sides, to two transversal elements (2*b*,3*b*) that respectively define a second side of the first and of the second longitudinal edge (2,3). The second transversal edge (6) is also connected, at a third perpendicular side to the previous ones, to a transversal element (4*b*) that defines a second side of the bottom (4).

The two transversal edges (5,6) may be the same, as in the embodiment shown, or may be different from each other.

Following the application of the transversal edges (5,6), it is possible to rotate the package resting on the bottom (4). From this step onwards, the package can be lifted, transported and stored resting on the bottom (4). Thanks to the presence of the longitudinal edges (2,3) and the transversal edges (5,6), mutually connected and connected to the bottom (4) as described above, the package is extremely solid and stable. Furthermore, the packages can be superposed with one another, arranging the bottom (4) of an upper package on the upper sides of the longitudinal edges (2,3) of a lower package, for a decisively higher number of packages than what is allowed by current packages. A further very important advantage of the package according to the present invention comes from the fact that the pile (P) rests on a lateral face, i.e. the tiles (T) are arranged resting on a lateral face (E). In such a position the tiles (T) can sustain notable vertical loads, and therefore various piles (P) can be superposed on each other vertically by resting on a lateral face, strongly reducing risks of damage.

To further increase the strength and stability of the package, it is possible to associate one or more upper elements (8) with a second longitudinal side of the first and of the second lateral edge (2,3), i.e. with the upper side of the lateral edges (2,3). Such one or more upper elements (8) may be arranged longitudinally, as in the embodiment shown, and/or transversally. In the embodiment shown, two upper elements (8) are each associated with the transversal elements (2*b*,3*b*) of a respective longitudinal edge (2,3). The upper elements (8), however they are arranged, can perform the function of support elements for the bottom (4) of an upper package. For example, in the embodiment shown, the longitudinal elements (4*a*) of the bottom (4) of an upper package can be arranged on the upper elements (8) of a lower package. Furthermore, the longitudinal elements (4*a*) of the bottom (4) of the upper package can be removably constrained to the upper elements (8) of the lower package.

It is also possible to apply one or more containment bands (7) to the pile (P), on the flank opposite to the bottom (4), i.e. on the upper flank. Such one or more bands (7) are further connected to the longitudinal walls (2,3).

The bands (7) can be for example in the form of strips of paper or cardboard or plastic material, constrained to the flanks of the tiles (T) which are adjacent to each other for defining the upper flank of the pile (P). For example, the bands (7) can be glued to the upper flank of the pile (P).

The application of the bands (7) is performed before the application of the upper elements (8), in the event in which the latter are arranged longitudinally, or indifferently before or after the application of the upper elements (8), in the event in which the latter are applied transversally.

The bands (7) keep the pile (P) stable also following the removal of one of the longitudinal edges (2,3). For picking the individual tiles (T), after removing one of the longitudinal edges (2,3), it is possible to cut away each band (7), to release the tile (T) to be picked. The remaining tiles (T) are kept in position by the remaining portion of each band (7).

In the place of or in combination with the bands (7), it is possible to provide one or more movable hooks (not shown), that can be removably associated with the longitudinal edge (3) still present in the package, or with at least one of the upper elements (8) if provided, or with the transversal edges (5,6), and with the most external tile (T) of the pile (P). The movable hooks can be removed to allow the removal of the most external tile (T) of the pile (P), and be subsequently re-applied in a position such as to be engaged with the subsequent tile (T) of the pile.

Preferably, the longitudinal edges (2,3), the bottom (4) and the transversal edges (5,6), and the upper elements (8) if provided, are associated with one another through removable means. For example, to realise the various connections it is possible to use screws. In this way, the removal of a longitudinal edge (2,3) can be obtained by unscrewing the screws that connect it to the transversal edges (5,6).

The package obtained with the present invention may be sized to fit the tiles (T) that form the pile (P). In substance, the longitudinal edges (2,3) may be sized to fit the main surfaces (F,M) of the tiles (T), while the bottom (4) may be sized to fit the height of the pile (P) and the longitudinal edge of the longitudinal surfaces (2,3). The transversal edges (5,6) may be sized to cover the height of the pile (P).

Figure 5:
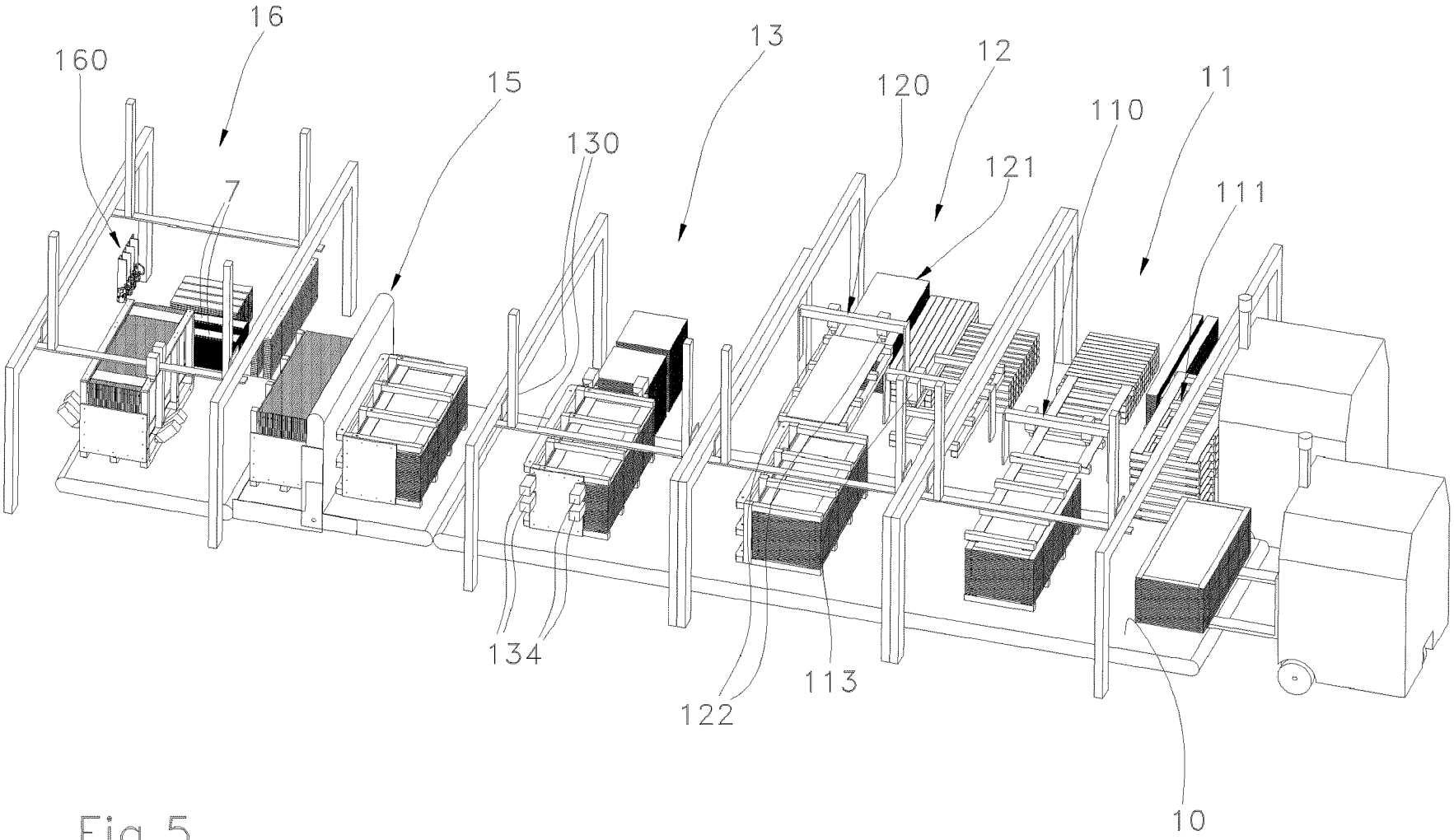
FIGS. 5 and 6 show two possible embodiments of a system for realising the package according to the present invention.
Figure 6:
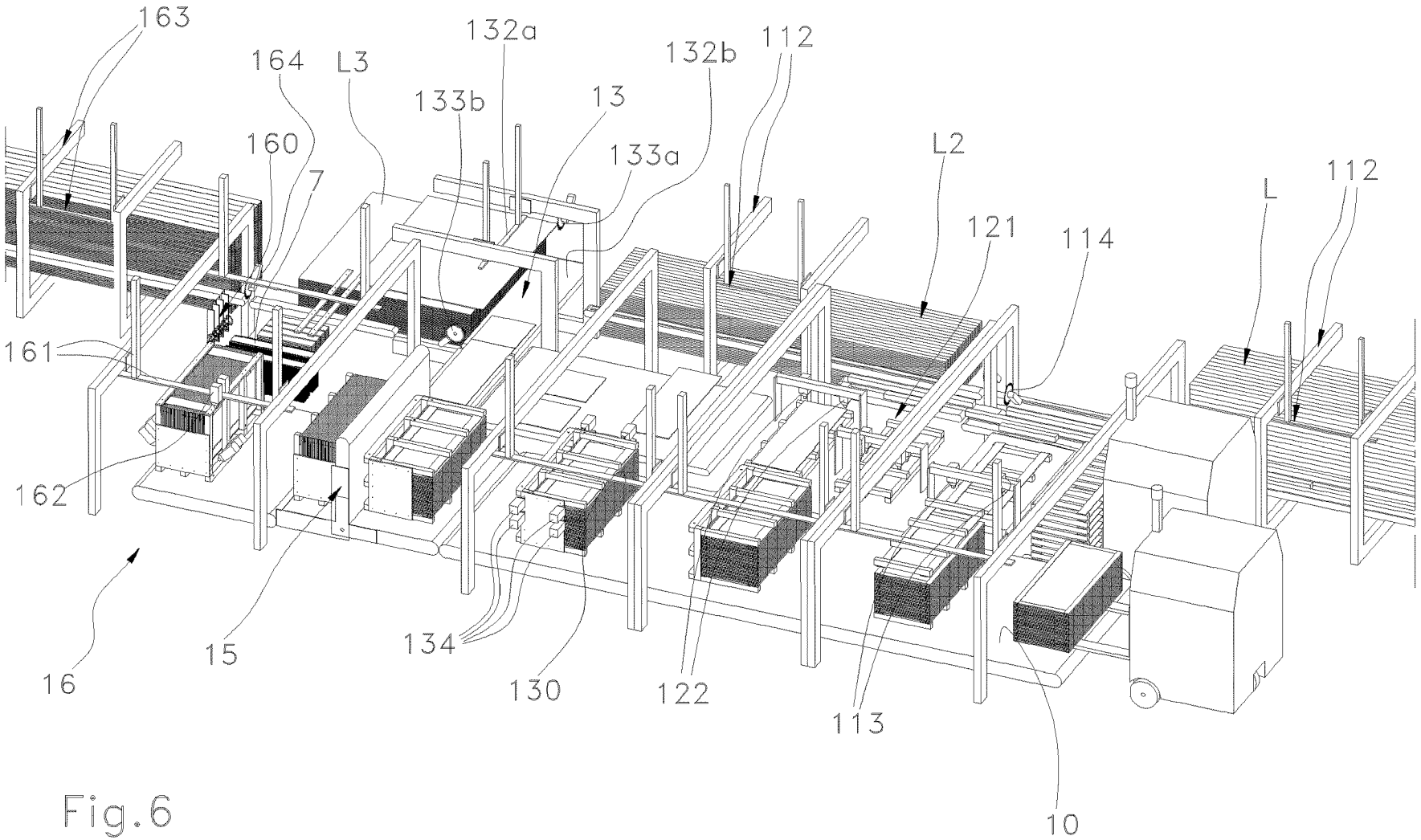

The method according to the present invention can be actuated with the aid of a system represented schematically in FIGS. 5 and 6.

The system comprises a transport plane (10) predisposed to drive in advancement along a direction (Z) the piles (P) arranged resting on a respective first longitudinal edge (2). The transport plane (10) can be adjusted in width, i.e. in a direction perpendicular to the advancement direction (Z). For that purpose, the transport plane (10) can be defined by a pair of chains or conveyor belts, arranged so as to define a substantially horizontal transport plane and separated from each other by an adjustable distance. This allows the width of the transport plane (10) to be adapted to the dimensions of the first longitudinal edge (2). The transport plane (10) is not described in further detail as it is known to a person skilled in the art.

The system comprises a first operating station (11), provided with a first handler (110) predisposed to pick and position a second longitudinal edge (3) on the pile (P). The first operating station could be provided with a warehouse (111) for containing a predefined number of longitudinal edges (3). Furthermore, the first operating station (11) may be provided with a cutting and assembly device (112) predisposed to realise the longitudinal edges (3) according to predefined measurements, e.g. corresponding to the plan measurements of the main surfaces of the tiles (T). In that case, the system may be provided with a warehouse for beams or strips (L,L2), from which the cutting and assembly device can pick and cut the beams or strips (L) to the desired measurements, for realising, for example, the longitudinal and transversal elements (3*a*,3*b*) with which to compose the longitudinal edges (3). Subsequently, the cutting and assembly device may constrain the longitudinal and transversal elements (3*a*,3*b*) to each other. Such operation can be performed with the aid of one or more boring and screwing heads (113), predisposed to assemble the elements (3*a*,3*b*) using screws. Alternatively, nails or glue could be used, through nailing or gluing heads, or other equivalent means. The cutting and assembly device can be activated by a control module which is programmable based on the required dimensions for the longitudinal edges (3). Neither the first handler (110) nor the cutting and assembly device provided with cutting heads (114) and boring and screwing heads (113) are described in further detail as they are realised according to different solutions all known to a person skilled in the art.

The same cutting and assembly device (112) can also be used for the realisation of the first longitudinal edge (2) given that, normally, the two longitudinal edges (2,3) are the same as each other. In that case, the longitudinal edges (2,3) realised can be located in a single warehouse (111) from which they can then be picked both to be sent to a pile (P) formation station (not shown), and for being located above the piles (P) fed to the transport plane (10).

The system comprises a second operating station (12), provided with a second handler (120), predisposed to pick and position a bottom (4) of the package at a first longitudinal side of the first and of the second longitudinal edge (2,3) alongside a first longitudinal side of the pile (P). The second handler (120) is not described in further detail as it can be performed according to different solutions, all known to a person skilled in the art.

As in the case of the first operating station (11), also the second operating station (12) could be provided with a warehouse (121) for containing a predefined number of bottoms (4). Furthermore, the second operating station (12) can be provided with a cutting and assembly device predisposed to realise the bottoms (4) according to predefined measurements. In that case, the system may be provided with a warehouse for beams or strips (L,L2), from which the cutting and assembly device can pick and cut the beams or strips (L,L2) to the desired measurements, for realising, for example, the longitudinal and transversal elements (4*a*,4*b*) with which the bottoms (4) are composed. Subsequently, the cutting and assembly device may constrain the longitudinal and transversal elements (4*a*,4*b*) to each other. Such operation can be performed with the aid of one or more boring and screwing heads (122), predisposed to assemble the elements (4*a*,4*b*) using screws. Alternatively, nails or glue could be used, through nailing or gluing heads, or other equivalent means. The cutting and assembly device can be activated by a control module which is programmable based on the required dimensions for the bottoms (4). If envisaged, the second operating station can be provided with a means for also applying the panel (4*c*) to the bottom (4). The panel (4*c*) may already be available at the necessary measurements, or it could be cut to the necessary measurements, through cutting means, directly in the second operating station (12).

In the embodiment shown, the cutting and assembly device (112) serves both the first and the second operating station (11,12), i.e. the cutting and assembly device (112) realises both the longitudinal edges (2,3) and the bottoms (4).

The second operating station (12) could further be provided with a fixing device (not illustrated), predisposed to fix the bottom (4) to the longitudinal edges (2,3) if such fixing were required. In that case, the fixing device could be provided with boring and screwing heads, for fixing through screws, or other tools, in the case of fixing through other means (e.g. glue or nails).

The system comprises a third operating station (13), provided with a third handler (130), predisposed to pick and position a first transversal edge (5) of the package at a first transversal side of the first and of the second longitudinal edge (2,3) at a first transversal flank of the pile (P). Preferably, but not necessarily, the third operating station (13) through the handler (130), also picks and positions the second transversal edge (6) of the package at the second transversal side of the longitudinal edges (2,3), on the other transversal flank of the pile (P).

The third operating station (13) may be provided with a warehouse (131) for containing a predefined number of transversal edges (5,6). Furthermore, the third operating station (13) can be provided with a cutting device and a fixing device (134). The cutting device is predisposed to realise the transversal edges (5,6) according to predefined measurements. In that case, the system can be provided with a warehouse for slabs or panels (L3), from which the cutting device (132,133) can pick and cut the panels to the desired measurements. In the embodiment illustrated, the cutting device comprises a first handler (132*a*), predisposed to pick the panels (L3) and to feed them to a first cutting head (133*a*), which is predisposed to realise a first cut along a first direction. A second handler or a transport plane (132*b*) is predisposed to feed the portions of panel to a second cutting head (133*b*), which is predisposed to realise a second cut along a second direction perpendicular to the previous one, and thus obtain the transversal edges (5,6) that can be accumulated in the warehouse (131). Preferably, but not necessarily, the transversal edges (5,6) are the same as each other, and can therefore be accumulated in a single warehouse (131).

The fixing device (134) comprises one or more boring and screwing heads, predisposed to fix the transversal edges (5,6) through screws. Alternatively, nails or glue could be used, through nailing or gluing heads, or other equivalent means. The cutting device (132*a,b*,133*a,b*) and the assembly device (134) can be activated by a control module which is programmable based on the required dimensions for the transversal edges (5,6).

In the embodiment shown, the assembly device (134), as well as fixing the transversal edges (5,6) to the longitudinal edges (2,3), also fixes the transversal edges (5,6) to the bottom (4). In this way, the bottom (4) is fixed to the longitudinal edges (2,3) by means of the transversal edges (5,6).

Neither the third handler (130) nor the cutting and assembly device (132*a,b*,133*a,b*), nor the assembly device (134) are described in further detail as they are realised according to different solutions all known to a person skilled in the art.

If the transversal edges (5,6) were formed by longitudinal and transversal elements like the longitudinal edges (2,3), the third operating station (13) could be provided with a cutting and assembly device like the one described for the first operating station (11), to realise the longitudinal and transversal elements and to constrain them to each other. The cutting and assembly device of the third operating station (13) could be distinct with respect to that of the first operating station (11), or it could be the same one.

In a possible embodiment (not illustrated), the system may be provided with a fourth operating station, distinct from the third operating station (13), provided with its own handler, predisposed to pick and position a second transversal edge (6) of the packaging at a second transversal side of the first and of the second longitudinal edge (2,3), on the second transversal flank of the pile (P), and a fixing device, predisposed to associate the second transversal edge (6) with the longitudinal edges (2,3). In this embodiment, the transversal edges (5,6) are therefore handled separately.

The system further comprises a tipping device (15), predisposed to rotate the package and arrange it resting on the bottom (4). The tipping device (15) operates on the package already complete with a bottom (4), longitudinal edges (2,3) and transversal edges (5,6). The rotation of the package is therefore relatively easy. The tipping device (15) is only illustrated schematically, as it is available in various forms for a person skilled in the art.

The system can also be provided with an auxiliary station (16), comprising a fourth handler (160), predisposed to pick and apply one or more containment bands (7) to the pile (P), on the side facing upwards. The fourth handler (160) can be provided with one or more gluing heads, for predisposing a layer of glue on the bands (7) to be applied to the pile (T).

Furthermore, the auxiliary station (16) can be provided with a fourth handler (161), predisposed to pick and position one or more upper elements (8) on the second longitudinal side of the first and of the second lateral edge (2,3), i.e. on the upper side. The auxiliary station (16) can also be provided with a fixing device (162), predisposed to associate said one or more upper elements (8) with the lateral edges (2,3). Such operation can be performed with the aid of one or more boring and screwing heads, predisposed to fix the upper elements (8) using screws. Alternatively, nails or glue could be used, through nailing or gluing heads, or other equivalent means.

Like the first and the third operating station (11,13), also the auxiliary station (16) can be provided with a cutting device (163,164) predisposed to cut the upper elements (8) to a predefined size. For that purpose, the auxiliary station (16) is provided with an auxiliary handler (163), predisposed to feed bars or strips (L4) to a cutting head (164) that fashions the upper elements (8). The latter can be arranged in a warehouse (165) from which they can be picked by the fifth handler (161). The cutting device (163,164) can be activated by a control module which is programmable based on the dimensions required for the upper elements (8).

As for the previous stations, also for the auxiliary station (16), neither the handlers (160,161) nor the cutting device (163,164), nor the fixing device (162) are described in further detail as they are realised according to different solutions all known to a person skilled in the art.

The operating stations (11,12,13,16) and the tipping device (15) are located in succession along the transport plane (10). This can be activated in advancement with a stepper motor, with timed breaks so as to allow the performance of the various operations described in each operating station. It is also possible to provide auxiliary transport devices, not illustrated, that transfer the package from the transport plane (10) to the operating stations (11,12,13,16) to allow the performance of the operations described without engaging the transport plane (10).

All the operating stations (11,12,13,16) described above, and the devices by which they are served, like the transport plane (10) and the tipping device (15), can be controlled by a general system control module. Such control module, through specific algorithms, can control and synchronise the operation of the various cutting and assembly devices, of the transport plane (10) and of the tipping device, in order to create the longitudinal edges (2,3), the transversal edges (5,6), the bottom (4) and the upper elements (8) at the most suitable measurements to contain a certain format of tiles (T), and to correctly compose the package according to the present invention.

The invention claimed is:

1. A method for realising a package comprising the following steps:

a) arranging a first longitudinal edge (2) of the package in a substantially horizontal position;

b) stacking a predefined number of ceramic tiles (T) to form a pile (P) on the first longitudinal edge (2);

c) providing a second longitudinal edge (3) of the package which is unfixed to the first longitudinal edge (2) of the package and arranging said unfixed second longitudinal edge (3) of the package on the pile (P);

d) associating a bottom (4) of the package with a first longitudinal side of the first and of the second longitudinal edge (2,3), on a bottom flank of the pile (P);

e) associating a first transversal edge (5) of the package with a first transversal side of the first and of the second longitudinal edge (2,3), on a first transversal flank of the pile (P);

f) associating a second transversal edge (6) of the package with a second transversal side of the first and of the second longitudinal edge (2,3), on a second transversal flank of the pile (P);

g) rotating the package so that the package is resting on the bottom (4).

2. The method according to claim 1, comprising a step of applying one or more containment bands (7) to the pile (P), on the side facing upwards opposite to the bottom (4).

3. The method according to claim 1, comprising a step of associating one or more upper elements (8) with a second longitudinal side of the first and of the second longitudinal edge (2,3).

4. The method according to claim 3, wherein said one or more upper elements (8) are arranged longitudinally and/or transversally.

5. The method according to claim 1, wherein the longitudinal edges (2,3), the bottom (4) and the transversal edges (5,6) are associated with each other through a removable means.

* * * * *